US009506232B2

(12) United States Patent
Terry

(10) Patent No.: US 9,506,232 B2
(45) Date of Patent: Nov. 29, 2016

(54) LID-ACTUATED TOILET FLUSHING APPARATUS

(71) Applicant: Steven Webster Terry, Santa Cruz, CA (US)

(72) Inventor: Steven Webster Terry, Santa Cruz, CA (US)

( * ) Notice: Subject to any disclaimer, the term of this patent is extended or adjusted under 35 U.S.C. 154(b) by 249 days.

(21) Appl. No.: 14/226,742

(22) Filed: Mar. 26, 2014

(65) Prior Publication Data

US 2014/0338113 A1 Nov. 20, 2014

Related U.S. Application Data

(63) Continuation-in-part of application No. 61/805,221, filed on Mar. 26, 2013.

(51) Int. Cl.
*E03D 5/04* (2006.01)

(52) U.S. Cl.
CPC ..... *E03D 5/04* (2013.01)

(58) Field of Classification Search
CPC ..... E03D 5/04
USPC ..... 4/405, 408, 411, 412
See application file for complete search history.

(56) References Cited

U.S. PATENT DOCUMENTS 3,590,397 A * 7/1971 Akamatsu ..... E03D 5/04 4/249
5,319,810 A * 6/1994 Metzger ..... E03D 5/04 4/408
5,400,446 A * 3/1995 Bloemer ..... E03D 5/04 4/408

* cited by examiner

*Primary Examiner* — Tuan N Nguyen
(74) *Attorney, Agent, or Firm* — Patrick Reilly

(57) ABSTRACT

A toilet bowl lid actuated linkage toilet flushing system wherein a conventional toilet-flushing flapper is actuated by a drain pull chain controlled relative to the positioning of the toilet bowl lid to the toilet. The toilet bowl lid must be moved from an upward position to a downward position to flush the toilet, which a magnetic plastic ribbon actuator mechanism is provided for completion of the toilet flush even when the toilet bowl lid remains in the downward position. Movement of the lid actuates a magnetic flush pull of a plastic ribbon that is linked to a drain pull chain connected to the flapper. An alternate version of the toilet bowl lid actuated linkage toilet flushing system is compatible with flushometer toilets and enables an opening and closing of a valve controlling outflow of a pressurized water source.

20 Claims, 16 Drawing Sheets

LID-ACTUATED TOILET FLUSHING APPARATUS

CO-PENDING APPLICATION

The present Nonprovisional patent application is a Continuation application of U.S. Provisional Patent Application Ser. No. 61/805,221 titled "Lid-actuated Toilet Flusher" and filed on Mar. 26, 2013. The present Nonprovisional patent application claims the priority date of Provisional Patent Application Ser. No. 61/805,221. Furthermore, Provisional Patent Application Ser. No. 61/805,221 is hereby incorporated into the present Nonprovisional patent application in its entirety and for all purposes.

FIELD OF THE INVENTION

The present invention relates generally to plumbing fixtures and more particularly to toilets.

BACKGROUND OF THE INVENTION

The prior art includes flushing toilets. In the past, it has been suggested to modify such toilets to flush in response to a lowering of the toilet bowl lid toward the bowl of the toilet. This dynamic both reduces air contamination creating by a release of material from within the bowl of the toilet and generated during a flush process, and reduces the incidence of users later sitting down on the toilet when the seat is up.

The prior art systems, however, are not optimally adaptable to prior art toilets and preexisting toilet designs. There is thus a long felt need for a device designed to a lowering of the toilet bowl lid acts to trigger a flushing action of the instant toilet and that may be integrated into a wide variety of prior art toilets and toilet designs, including new toilet builds. It is an object of the present invention to couple the lid of a toilet to a mechanism of the same toilet to cause the toilet to flush upon a lowering of the toilet seat.

SUMMARY OF THE INVENTION

Towards this object and other objects of the present invention that will be made obvious in light of the present disclosure, an apparatus is provided that detachably couples a toilet bowl lid with a valve control, whereby motion of the toilet bowl lid causes the valve control to release water into a bowl of the toilet and thereby flush out at least most of the fluid and contents of the toilet bowl.

In a first preferred embodiment of the present version, an arm is detachably attachable with a lid element. The arm includes a flexible member joined with a coupling end. The coupling end and the lid element are detachably attachable and are magnetically attracted together in certain alternate preferred embodiments of the present invention. The toilet element is preferably securely and durably attached to the toilet bowl lid.

The flexible member is coupled with a pull chain of the prior art flush toilet within a water tank of the toilet and the coupling end is detachably coupled with the lid element when the toilet bowl lid is in an open position relative to the toilet bowl.

It is understood that the prior art pull chain is typically attached to a prior art flapper, and that the flapper is rotatably coupled within the water tank, wherein the flapper is adapted to alternately permit and block water from proceeding from flowing from the water tank and into the toilet bowl via a toilet tank drain.

The arm is dimensioned such that the arm and the flush chain in combination do not allow the coupling end to maintain contact with the lid element when the toilet bowl lid is lowered to substantively cover the toilet bowl (i.e. when the toilet bowl lid is in a lowered or down position relative to the toilet bowl).

In typical use, the coupling end is detachably coupled to the toilet bowl lid when the toilet bowl lid is substantively upright and rotated away from the toilet bowl. As a user lowers and rotates the toilet bowl lid toward the toilet seat, the arm is pulled toward an outside of the water tank of the toilet, whereby the flush chain is pulled substantively upwards within toilet tank and the flush chain rotates the flapper and the toilet tank drain is exposed. A water volume flows from the water tank and into the toilet bowl as the flapper is rotated to expose the toilet tank drain. The coupling of the flapper to the toilet tank and the flush chain limit the extent to which the arm can be pulled toward the outside of the water tank. The arm is preferably sized to cause the arm coupling element and the lid element to be pulled apart prior to the lowering of the toilet bowl lid fully into the down position. When the toilet bowl lid is later raised to a fully open position relative to the toilet bowl, the arm coupling end and the lid element are sized, adapted and positioned to cause the arm coupling end and the lid element to resume a detachable coupling.

In another alternate preferred embodiment of the present invention, a guide element is provided that guides and supports the arm flexible member in movement and positioning of the flexible member relative to the prior art flush chain, flapper and toilet tank. The guide element may be adapted to be coupled onto a wall of the toilet water tank and is adapted to support a curving of the arm flexible member as instantiated between the toilet tank wall and the flush chain.

In still other various alternate embodiments of the present invention, the arm coupling element may be or comprise a ferromagnetic material and the lid or portion of the lid may be or comprise a magnet or magnet material, whereby the arm coupling element and the lid are detachably attachable by magnetic force.

In yet other various alternate embodiments of the present invention, the arm coupling element may be or comprise a magnet or magnetic material and the lid or portion of the lid may be ferromagnetic or comprise a ferromagnetic material, whereby the arm coupling element and the lid are detachably attachable by magnetic force.

In a yet alternate preferred embodiment of the present version, a second arm is both (a.) durably attached to a flow valve of a tankless toilet comprising a flushometer, and (b.) detachably attached with a second toilet bowl lid. Movement of the second toilet bowl lid toward a toilet bowl of the tankless toilet pulls the second arm and thereby causes the flow valve to release water from a pressurized water source and into a toilet bowl of the tankless toilet. When the second toilet bowl lid is later raised to a fully open position relative to the toilet bowl of the tankless toilet, the arm coupling end and the second toilet bowl lid are sized, adapted and positioned to cause the arm coupling end and the second toilet bowl lid to resume a detachable coupling.

Figure 1:
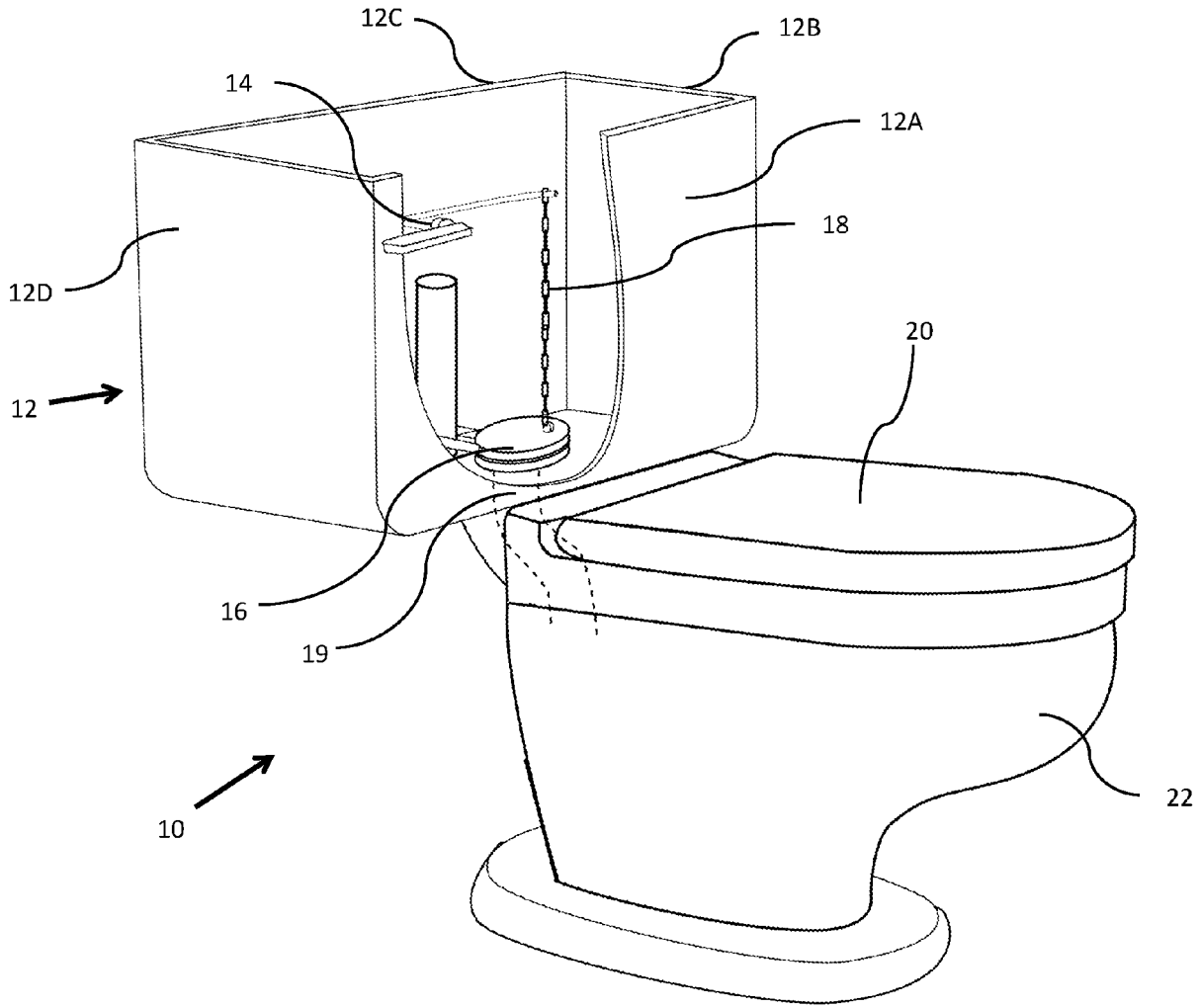
PRIOR ART FIGURE 1
FIG. 1 is a drawing of a cutaway view of a prior art toilet having a standard flush handle and a water tank ("toilet tank"), with a toilet tank lid removed, within which the present invention is not installed.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Wherever possible, the same reference numbers will be used throughout the drawings to refer to the same or like parts. The components in the drawings are not necessarily to scale.

Figure 4A:
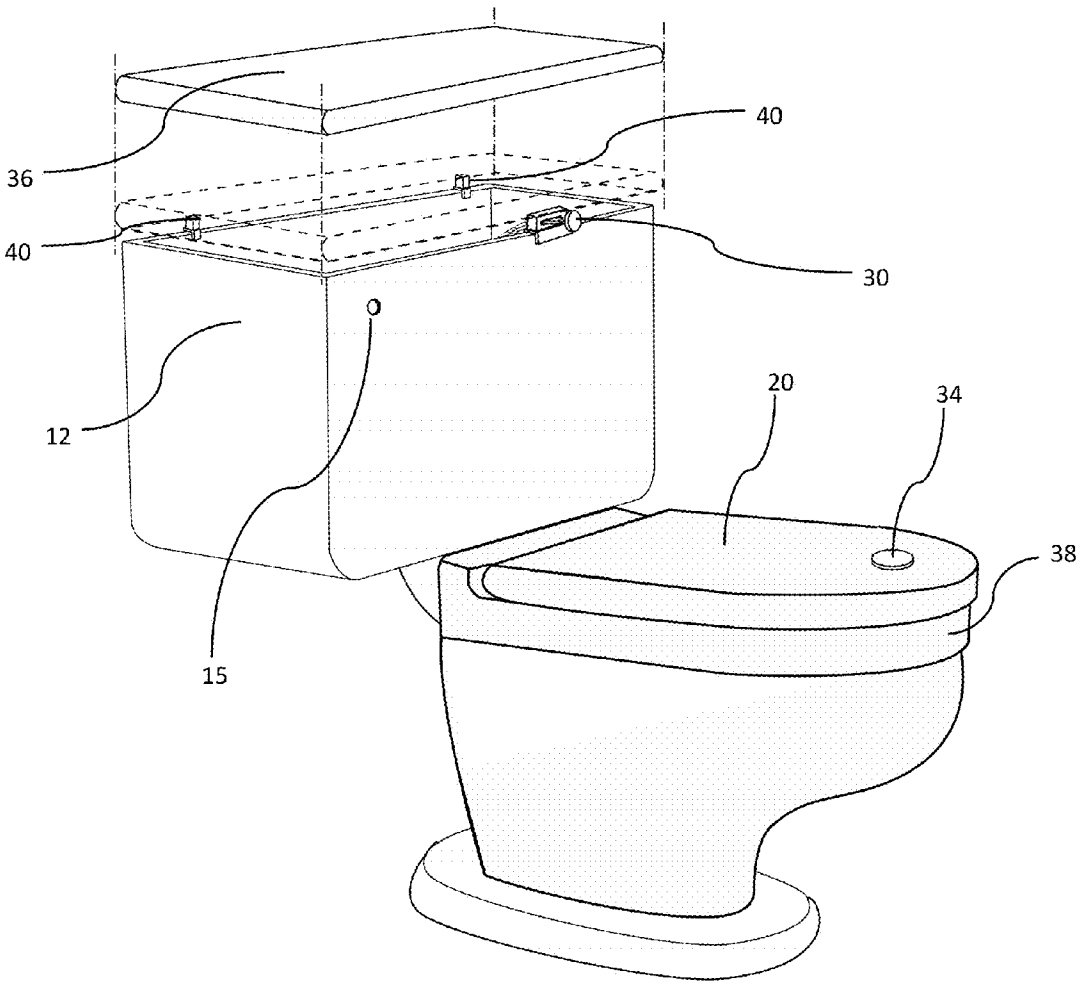
FIG. 4A shows two rear spacers resting on top of the toilet tank of FIG. 1, supporting the tank cover allowing space for the actuator linkage of FIG. 2 to move relative to the toilet tank of the toilet of FIG. 1 when in use.
Figure 4B:
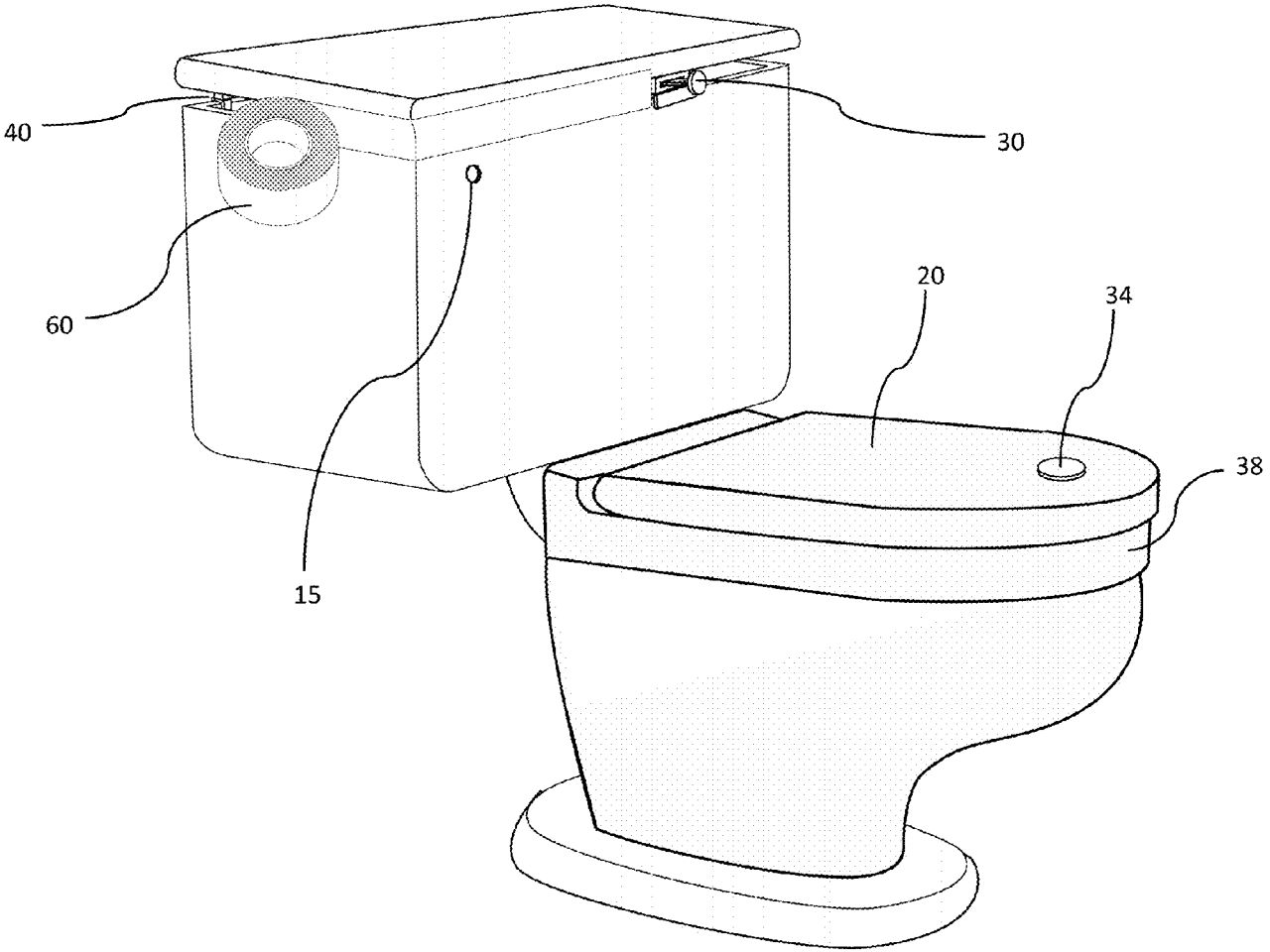
FIG. 4B shows the optional use of decorative tape to cover the gap between the toilet tank and the lid of the toilet of FIG. 1 when the spacers and the guide body of FIG. 2 are installed on the tank of the toilet of FIG. 1.

Referring now generally to the Figures and particularly to FIG. 1, a standard prior art gravity toilet 10 includes a toilet tank 12 coupled with a flush handle 14 that is attached through a hole 15 of a front tank wall 12A, as shown in FIGS. 4*a* and 4B, toward the top of the toilet tank 12, to a drain pull chain 18. The drain pull chain 18 is further connected to a flapper 16 that rests over and alternately covers and releases the toilet tank drain 19 at the bottom of the toilet tank 12. Manual rotation of the flush handle 14 pulls up the drain pull chain 18. This in turn pulls the flapper 16 up, so that water in the toilet tank 12 drains out of the toilet tank 12 and into a toilet bowl 22 to flush out contents of the toilet tank 12. The toilet tank 12 comprises four walls 12A, 12B, 12C & 12D.

Figure 2:
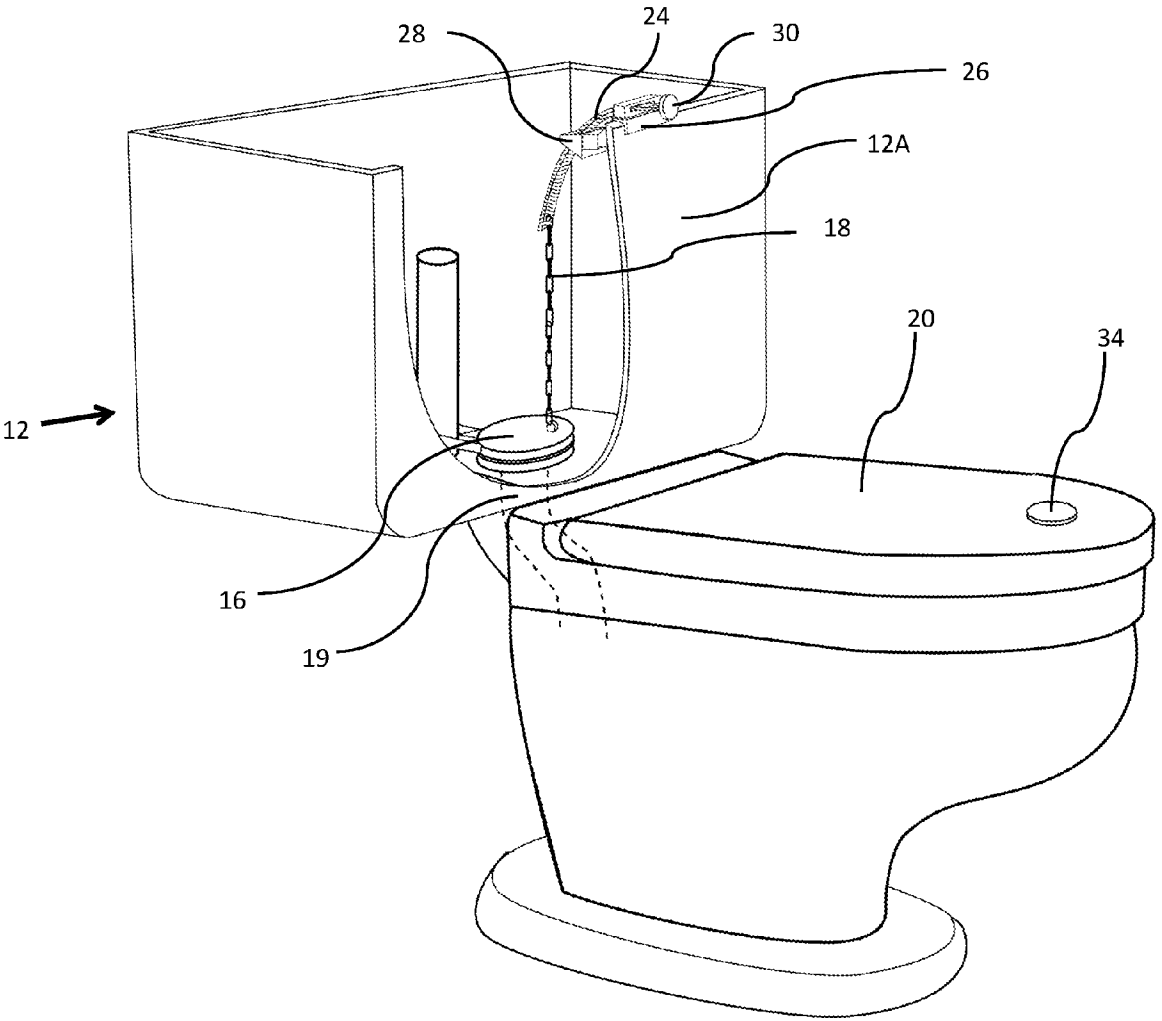
FIG. 2 is a drawing of a cutaway view of the toilet of FIG. 1, with the toilet tank lid and the standard flush handle removed, within which a preferred embodiment of the present invention comprising an actuator linkage with a guide body installed.

Referring now generally to the Figures and particularly to FIG. 2, the method of the present invention removes and replaces the prior art flush handle 14 with an actuator linkage 24. The removal of the flush handle 14 leaves exposed the tank hole 15, which can optionally be covered by a sticker (not shown).

A first end 24A of the actuator linkage 24 is coupled to the drain pull chain 18 in place of the flush handle 14. A second end 24B of the actuator linkage 24 coupled with a permanent magnet 30. The magnet 30 may be or comprise a SUPER MAGNET™ neodymium disc magnet marketed by Master Magnets, Inc. of Castle Rock, Colo. or other suitable magnet known in the art. The actuator linkage 26 may be formed to friction fit the magnet 30 into the actuator linkage second end 24B.

A toilet tank clip 26 of a linkage guide body 28 that rests on the top of the front toilet wall 12A. The linkage guide body 28 is a single piece construction that guides and supports the actuator linkage 24 and couples with a toilet tank front wall 12A. The actuator linkage 24 includes of a flat, flexible plastic ribbon 24C that moves forward over the linkage guide body 28 to enable a pulling of the drain pull chain 18, which in turns enables a lifting of the flapper 16 so that the toilet tank 12 can empty water into the toilet bowl 22 to cause a flushing of the toilet bowl 22.

After the toilet bowl lid 20 is separated from the magnet 30, the actuator linkage 24 moves back into the toilet tank 12 under the influence of gravity, whereupon the flapper 16 lowers to close over and cover the toilet tank drain 19 and thereby stopping water from proceeding from the toilet tank 12 to the toilet bowl 22. The linkage guide body 28 supports the weight of the actuator linkage 26 through out the usage cycle of the method of the present invention. The linkage guide body 28 is preferably sufficiently rigid to support the mass of actuator linkage 26 without deforming greater than 5 degrees, and may be made of a rigid material such as a metal a metallic compound, an acrylic plastice, and/or comprise other sufficiently rigid and durable materials known in the art.

Figure 3A:
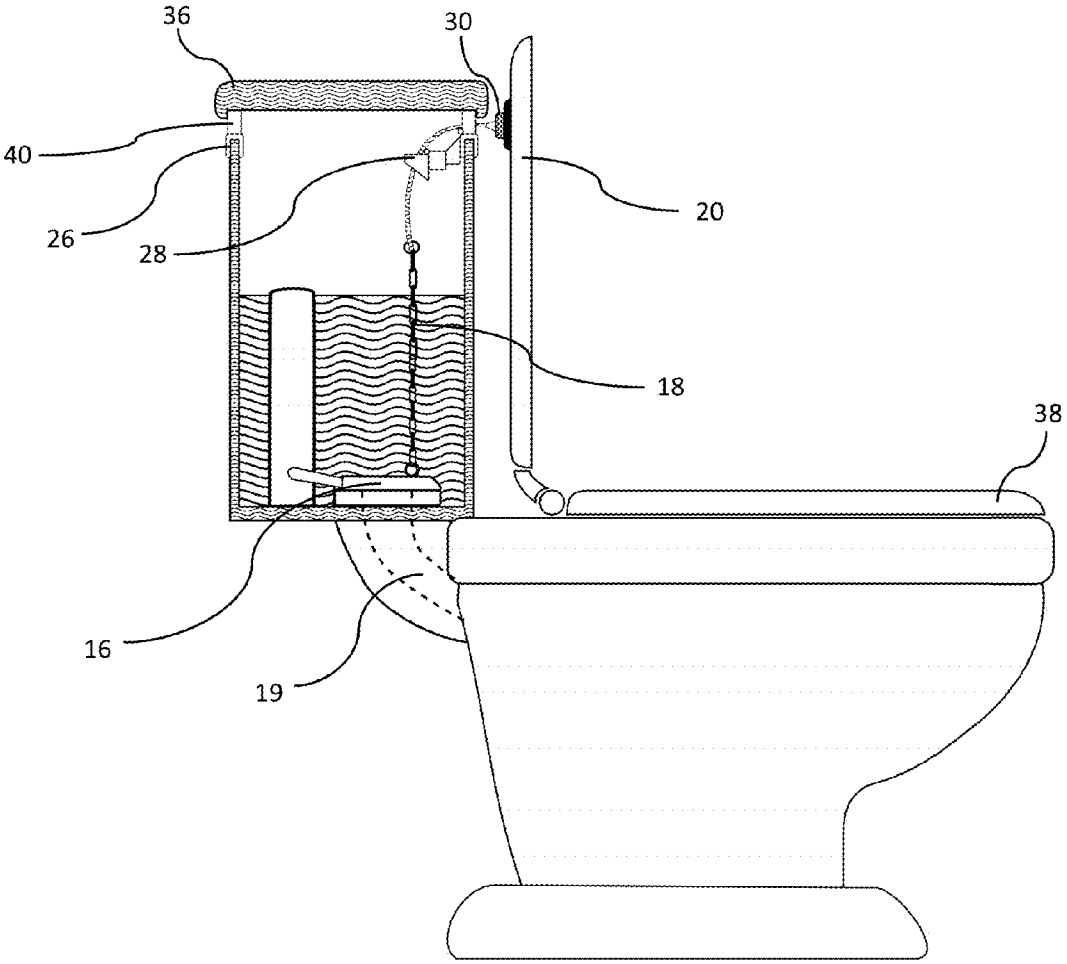
FIG. 3A shows a side view of the toilet of FIG. 1 and a cutaway view of the toilet tank of FIG. 1 with the toilet bowl lid open and the actuator linkage of FIG. 2 in the ready-to-use state.

Between flushing cycles, the second end 24*b* and the magnet 30 of the actuator linkage 24 protrudes outside of toilet tank 12 towards the front of the toilet 10 and preferably beyond the front toilet tank wall 12A. This positioning of the magnet 30 of the actuator linkage 24 beyond the end of the toilet tank front wall 12A enables the magnet 30 to engage (connect) with a ferromagnetic disc 34 affixed to the toilet bowl lid 20 when the toilet bowl lid 20 is in the "up"

position, as shown in FIG. 3A. It is understood that the ferromagnetic disk 30 may comprise iron, steel, and/or other ferromagnetic material.

Figure 3B:
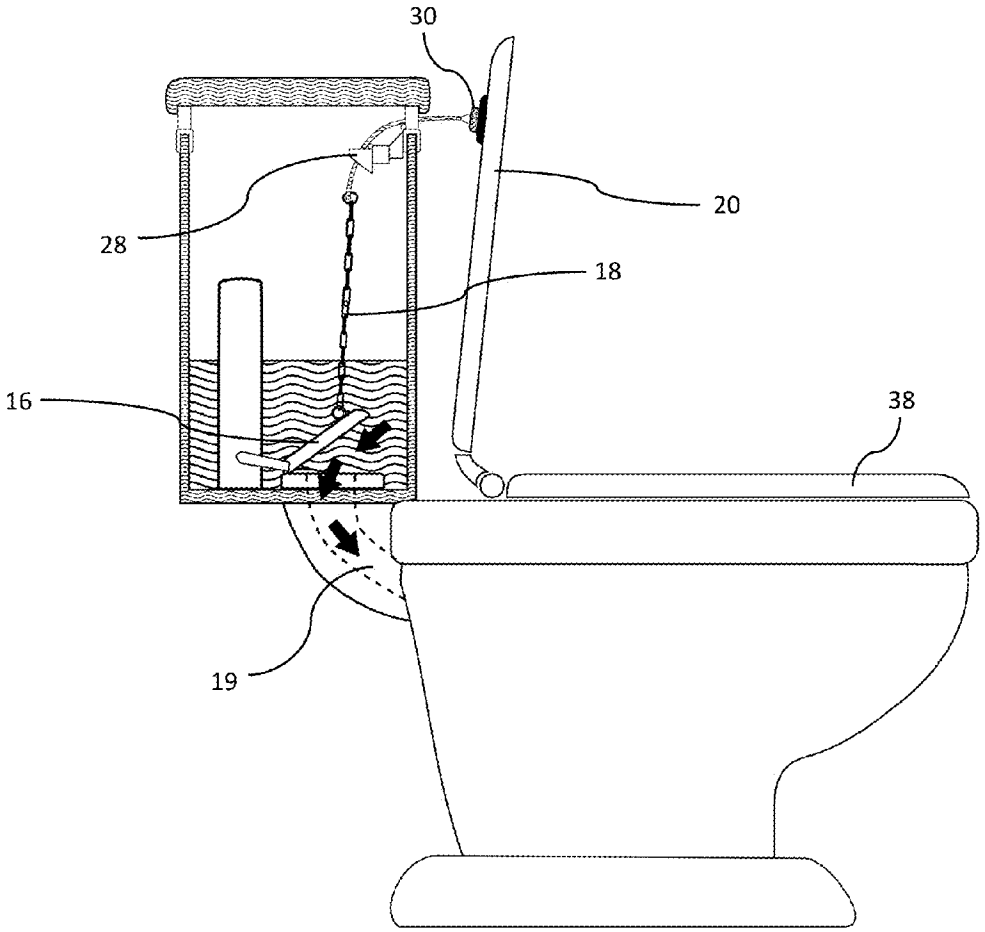
FIG. 3*b* shows flushing of the toilet of FIG. 1 initiated with the flap open and the actuator linkage of FIG. 2 in contact with the toilet bowl lid as the toilet bowl lid is beginning to be lowered.
Figure 3C:
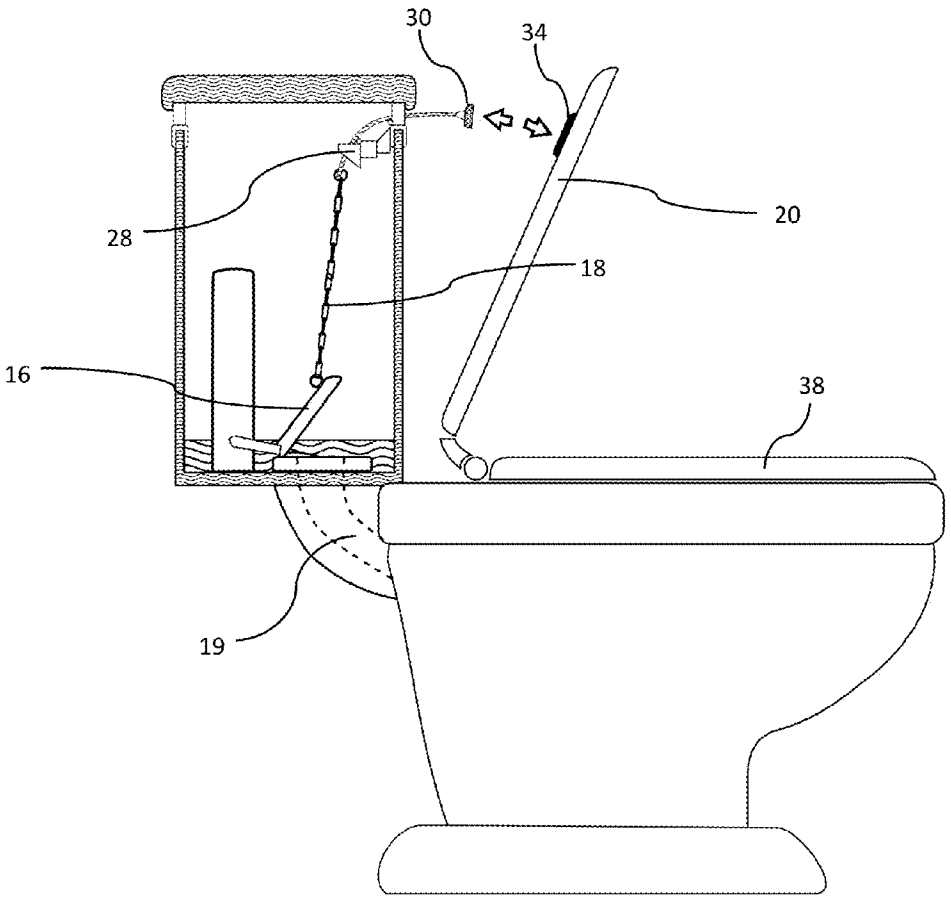
FIG. 3C shows the toilet of FIG. 1 releasing after flush, which the flap is open and the actuator linkage of FIG. 2 has separated from the toilet bowl lid of the toilet as the toilet bowl lid is lowered past a certain point.
Figure 3D:
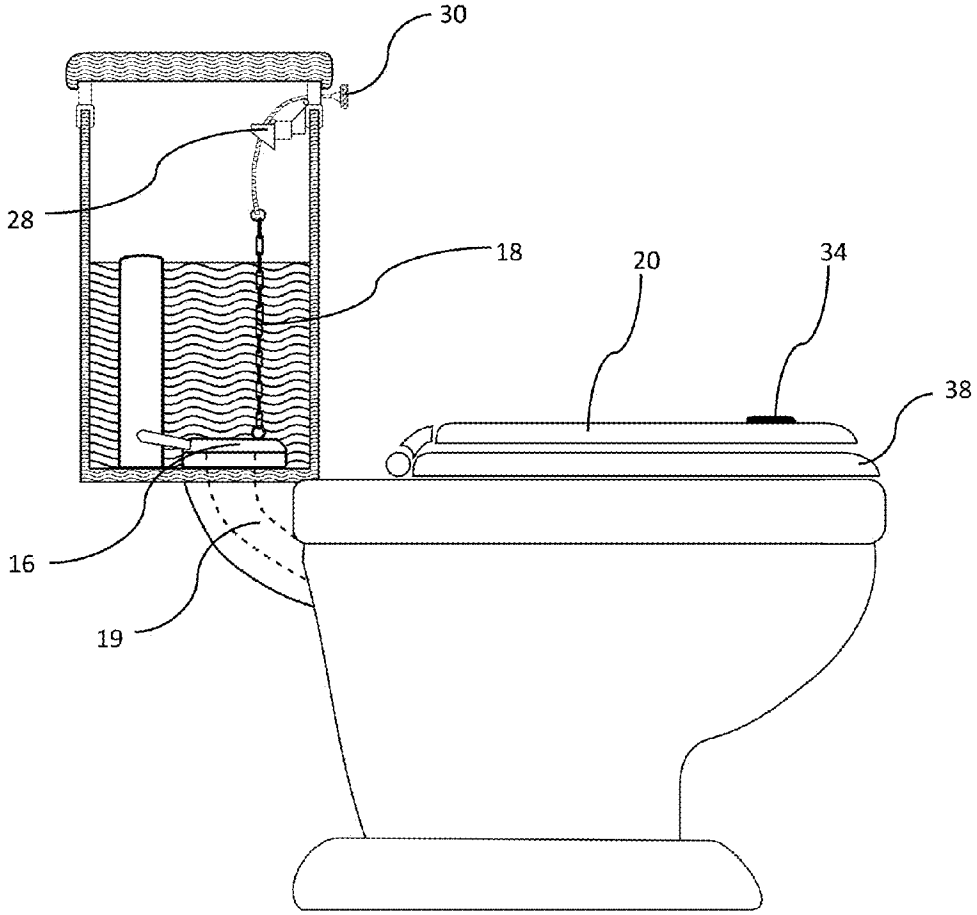
FIG. 3D shows the toilet bowl lid of the toilet of FIG. 1 in a down position and ready for next use, while the actuator linkage of FIG. 2 is at rest and the flapper on the tank is closed.

In this "initial position" of FIG. 3A, the toilet 10 is ready for use and the actuator linkage 24 is positioned to pull the drain pull chain 18 to flush the toilet 10 when the toilet bowl lid 20 is lowered to a fully lowered position of FIG. 3D. As the toilet bowl lid 20 is lowered, the actuator linkage 24 is pulled from its initial position in the direction of the front of the toilet 10 by the magnet 30 in contact with the ferromagnetic disc 34 on the toilet bowl lid 20. When the toilet bowl lid 20 is lowered past a certain point, the force of magnetic attraction between the magnet 30 and the ferromagnetic disc 34 is overcome by the movement of the toilet bowl lid 20 and magnet 30 and the ferromagnetic disc 34 separate.

The actuator linkage 24 thereupon returns to its initial position of FIG. 3A, wherein the magnet 30 protrudes from the toilet tank front wall 12A. This action of the actuator linkage 24 moving back to its initial position enables the drain pull chain 18 to also lower by force of gravity and further allows the flapper 16 to close by force of gravity. At that point the toilet tank 12 can fill with water again.

The actuator linkage 24 also protrudes over the top of the toilet tank 12 when the toilet bowl lid 20 is down. The toilet bowl lid 20 in FIG. 2 is shown in the down, or closed position, which is the position between flushing cycles. Shown also on the end of the toilet bowl lid 20 is the ferromagnetic disc 34 that will contact the end of the actuator linkage 24 near the toilet tank 12 wall when the toilet bowl lid 20 is in the up position.

Referring now generally to the Figures and particularly to FIG. 3A, FIG. 3A is a side view of the toilet 10 with a cutaway of inside the toilet tank 12 when it is filled with water. The toilet tank cover 36 is shown resting atop two rear cylindrical spacers 40, which rest on the top of a rear wall 12C of the toilet tank 12, and the linkage guide body 28, which also rests on the top front wall 12A of the toilet tank 12. The linkage guide body 28 includes two integral cylindrical spacers 42 that exist to support one of three points of contact between the toilet tank 12 cover and the top of the toilet tank 12. The two rear spacers 40 and the linkage guide body 28 each connect to the top of the toilet back wall 12C via a respective integral toilet tank clips 44. It is understood that each spacer 40 includes one individual integrated toilet tank clip 44 as a base.

In FIG. 3A the toilet bowl lid 20 is raised and the ferromagnetic disc 34 affixed to the toilet bowl lid 20 is in contact with the magnet 30 that is on the end of the protruding actuator linkage 24. The magnet 30 on the end of the actuator linkage 24 must be a permanent magnet 30 and may be a neodymium magnet 30 or other type of permanent magnet 30.

From the front of the toilet tank 12, the actuator linkage 24 runs from the magnet 30, over a front bearing 46 and over a rear bearing 48, both bearings part of the linkage guide body 28, to its connection to the drain pull chain 18. Thus the actuator linkage 24 is suspended between the position of the magnet 30 on one end and the drain pull chain 18 on the other end. For example, when the toilet bowl lid 20 is in the up position, as shown in FIG. 3A, the position of the magnet 30 end of the actuator linkage is determined by its contact with the ferromagnetic disc 34 on the toilet bowl lid 20, and remains so as the toilet bowl lid 20 is lowered until such point as the magnet 30 and ferromagnetic disc 34 release one another. When the toilet bowl lid 20 is in the down, or closed position, the position of the magnet 30 end of the actuator linkage is determined, instead, by the magnet retainer 50. The magnet retainer 50 is a flat plastic piece with horizontal stoppers 52 integral to either side of the magnet retainer 50, to which the magnet 30 is attached. The stoppers 52 contact the spacers 42 as the magnetic end of the actuator linkage 24 moves back towards the toilet tank 12 after flushing, preventing the magnet 30 end of the actuator linkage 24 from falling down into the toilet tank 12.

The protrusion of the actuator linkage 24 over the top of the toilet tank 12 walls enables the magnet 30 to contact the ferromagnetic disc 34 affixed to the toilet bowl lid 20. In the configuration shown in FIG. 3A, the flapper 16 is closed and holding water in the toilet tank 12, ready for a flush cycle. The toilet seat 38 is down and ready for use, but the toilet seat 38 may also be raised.

To operate the actuator linkage 24 in the flushing process, as shown in FIG. 3B, after use, the toilet bowl lid 20 is beginning to be lowered, which causes the actuator linkage 24 to move over the linkage guide body 28 towards the front of the toilet 10. The actuator linkage 24 continues to extend further beyond the top front of the toilet tank 12 as the toilet bowl lid 20 is lowered. The action of the ferromagnetic disc 34 affixed to the toilet bowl lid 20 engaged with and pulling the magnet 30 end of the actuator linkage 24 towards the front of the toilet causes the actuator linkage 24 to pull on the drain pull chain 18. As shown in FIG. 3B, the drain pull chain 18 raises the flapper 16 to allow water from the toilet tank 12 to flow into the toilet bowl 22. The toilet begins to flush as the toilet tank 12 drains.

Referring now generally to the Figures and particularly to FIG. 3C, FIG. 3C illustrates how further lowering of the toilet bowl lid 20 past a certain point causes the magnet 30 on the end of the actuator linkage 24 to ultimately release from the ferromagnetic disc 34 on the toilet bowl lid 20. FIG. 3C further shows how the actuator linkage 24 will move back over the linkage guide body 28 towards its initial position, such that the drain pull chain 18 will lower and the flapper 16 will close. Before the flapper closes, as shown in FIG. 3C, the toilet tank 12 water has flowed out of the toilet tank 12 and into the toilet bowl 22, and the flushing cycle has ended.

Referring now generally to the Figures and particularly to FIG. 3D, FIG. 3D the actuator linkage 24 is shown having returned back to its initial position, with the magnet 30 end of the actuator linkage 24 protruding over the top front of the toilet tank 12, the flapper closed and the toilet tank 12 refilled. The toilet bowl lid 20 is closed and ready for the next use.

Referring now generally to the Figures and particularly to FIG. 4A, FIG. 4A shows how the two rear spacers 24 are affixed to the top of the toilet tank 12 to support the toilet tank 12 cover, along with the linkage guide body 28, which is affixed to the top front of the toilet tank 12 via integral toilet tank clips 26. This configuration allows space for the actuator linkage 24 to move over the linkage guide body 28, between the toilet tank 12 cover and the toilet tank 12, when flushing or releasing. The toilet tank 12 cover is shown suspended above the toilet tank 12 to provide a view of the configuration of the rear spacers and the linkage guide body 28 affixed to the top of the toilet tank 12. The linkage guide body 28 must be positioned at the center of the top front of the toilet tank 12 such that the magnet 30 end of the actuator linkage 24 will make contact with the ferromagnetic disc 34 on the end of the toilet bowl lid 20 when the lid is in the up position.

Referring now generally to the Figures and particularly to FIG. 4B, a decorative tape 60 is shown as optional trim being applied to cover the gap between the top of the toilet tank 12 and the toilet tank cover 36 when the actuator linkage 24 is installed. The actuator linkage 24 is shown protruding over the top of the toilet tank 12 and slightly in front of the toilet tank cover 36 towards the front of the toilet.

Figure 5:
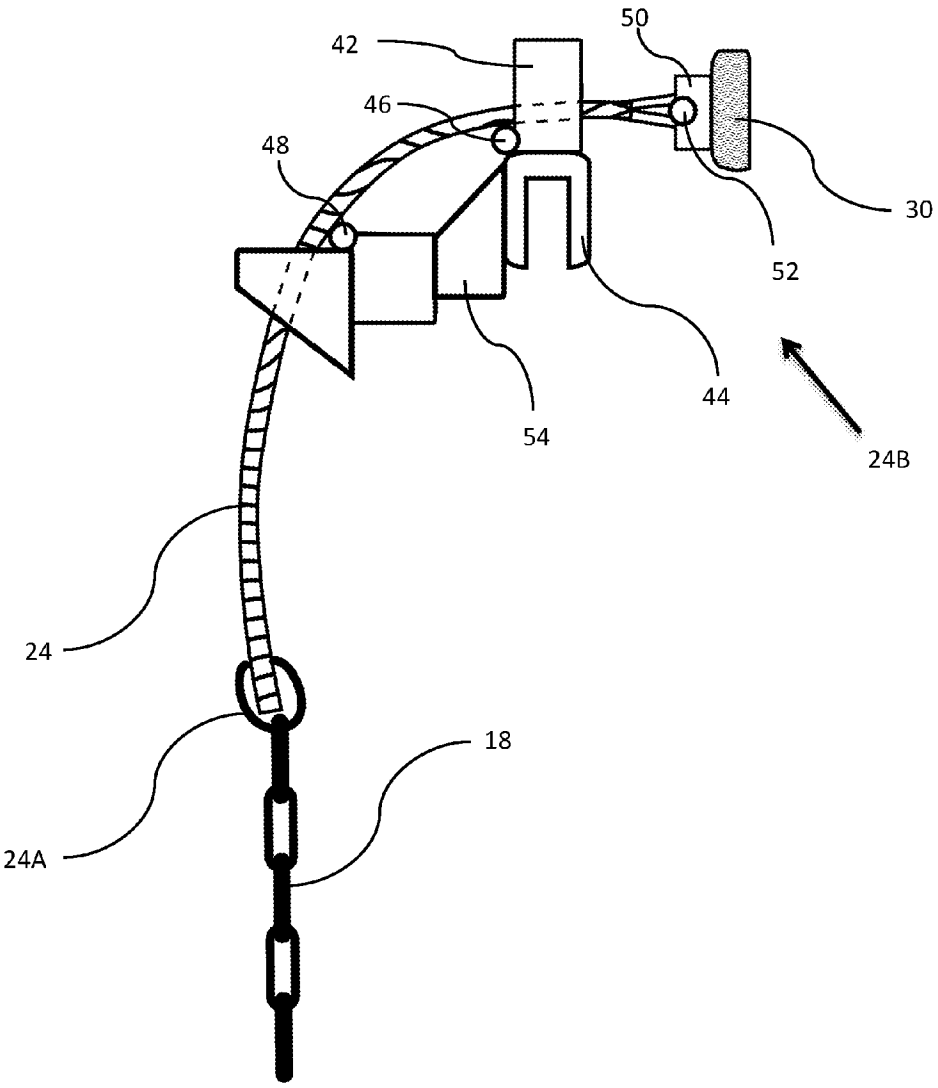
FIG. 5 is a line drawing of the actuator linkage of FIG. 2 in side view as the actuator linkage is shown in the vertical orientation, as it will rest on the top of the toilet tank of the toilet of FIG. 1.

Referring now generally to the Figures and particularly to FIG. 5, the device is shown in side view in vertical orientation as it will rest on the top of the toilet tank 12. The linkage guide body 28 includes an integral scaffold 54 to extend support from the tank wall clip 44 to the actuator linkage 24. The actuator linkage 24 runs from a connection to the toilet pull chain 18 over a rear bearing 48 in the linkage guide body 28 to a front bearing 46 to the top of the linkage guide body 28 between the spacers. In one embodiment the front bearing 46 may be fixed, while in another embodiment the front bearing 46 may rotate on the horizontal axis to facilitate smooth movement of the actuator linkage 24 in a back and forth orientation. The front bearing 46 and the rear bearing 48 together facilitate both support and friction to the actuator linkage 24, enabling it to move smoothly in a forward and backward motion with respect to the front of the toilet, as needed when pulling on or releasing tension on the drain pull chain 18. The actuator linkage 24 is shown terminating in the round permanent magnet 30.

Figure 6:
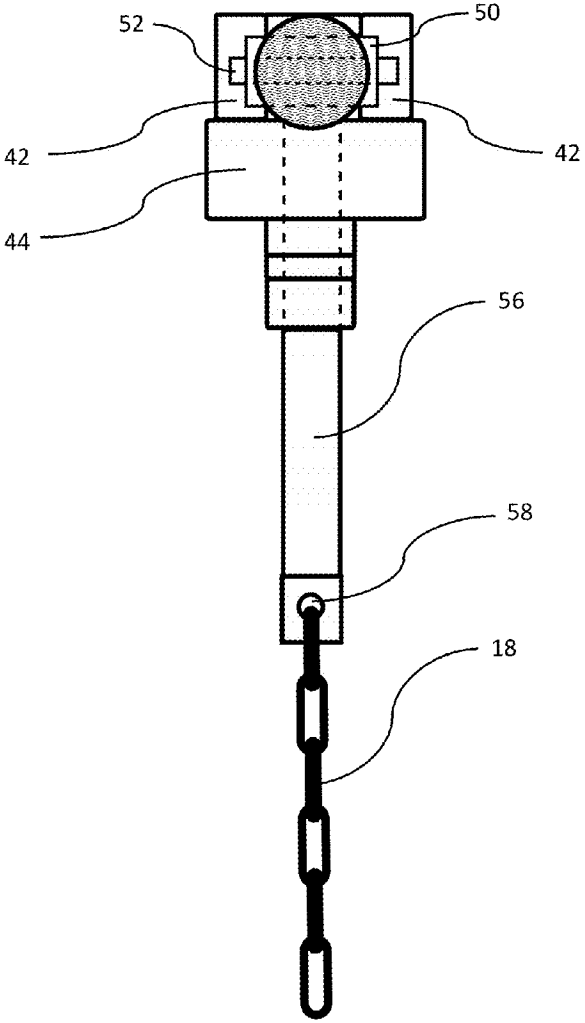
FIG. 6 is a front view of the actuator linkage and the guide body of FIG. 2.

Referring now generally to the Figures and particularly to FIG. 6, FIG. 6 provides a front view of the actuator linkage 24 running over the linkage guide body 28. On either side of the front of the linkage guide body 28 which mounts on top of the toilet tank 12 are two cylindrical spacers 42. Between the spacers 42 is shown the round magnet 30 end of the actuator linkage 24, which is attached to a magnet retainer 50 that is integral with the actuator linkage 24, such that the actuator linkage 24 is maintained at rest in the initial position. The magnet retainer 50 is shown with two integral stoppers 52 on either side that hit the spacers 42 when the actuator linkage 24 moves back towards the toilet tank 12 after disengaging from the ferromagnetic disc 34 on the toilet bowl lid 20 after flushing. The end of the actuator linkage 24 that runs down into the toilet tank 12 is shown terminating at its connection with the drain pull chain 18.

Figure 7:
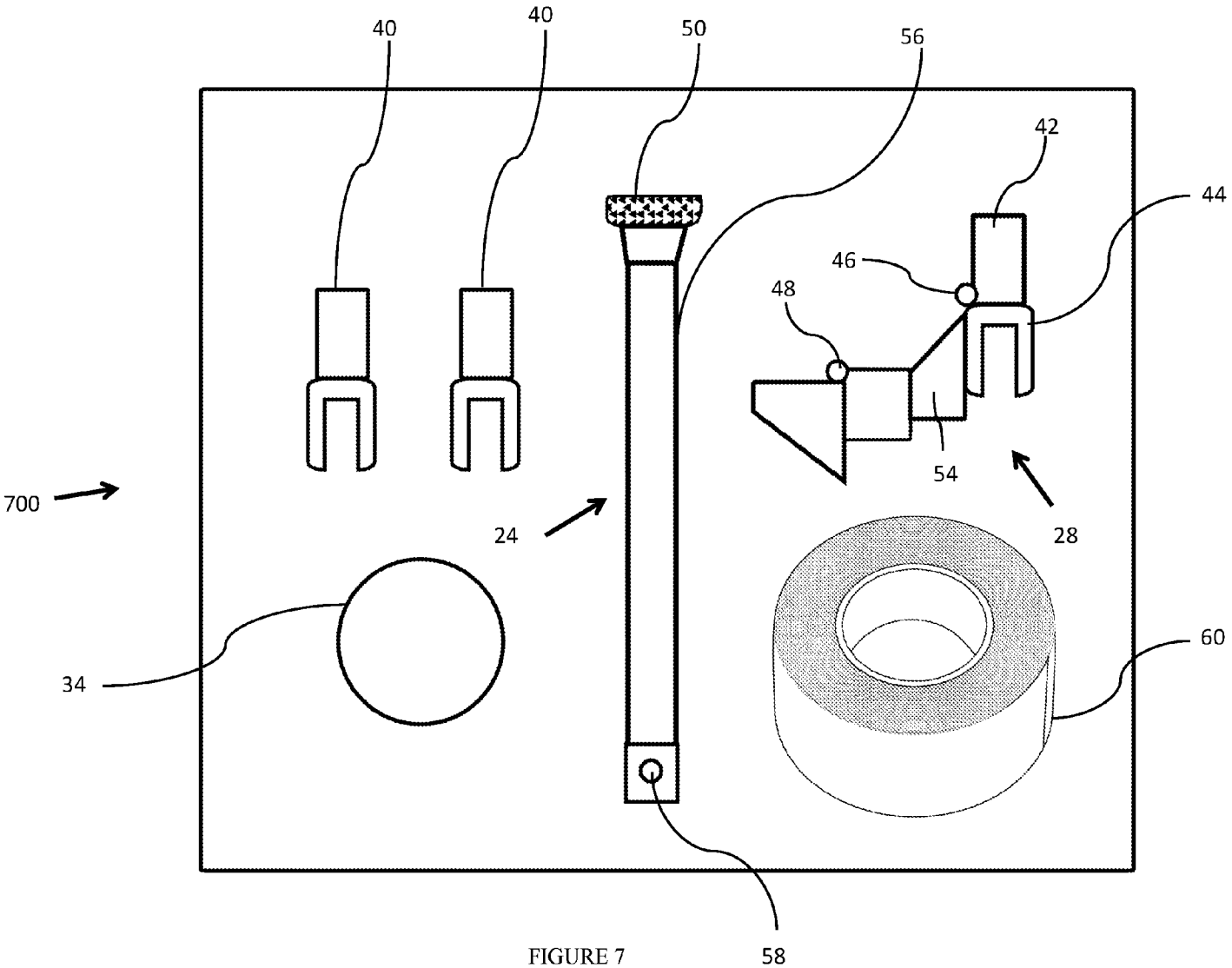
FIG. 7 shows several integral parts of the actuator linkage of FIG. 2 and several accessory spacers needed for installation, as well as optional decorative tape to cover the gap between the toilet tank and the tank cover when the actuator linkage is installed.

Referring now generally to the Figures and particularly to FIG. 7, a self-install kit 700 is shown in FIG. 7 and includes the linkage guide body 28, which includes two integral spacers 42, depicted in side view such that only one spacer 42 is visible. In side view, the spacers 42 are shown as integral with the toilet tank clips 44 and a scaffold structure 54, also integral to the linkage guide body 28. The linkage guide body 28 shows the integral rear bearing 48 and front bearing 46 over which the actuator linkage 24 moves. The actuator linkage 24 is shown as a flat semi-stiff plastic ribbon 56, which is terminated on one end by the magnet retainer 50 and magnet 30 and at the other end by an eye 58 through which the drain pull chain 18 can be hooked. The two separate spacers 40 are shown as necessary accessories to clip onto the toilet tank walls 12A-12D to support the toilet tank cover 36 when the actuator linkage is installed. The ferromagnetic disc 34 is included for affixing to the center end of the toilet bowl lid 20, positioned such that when the toilet bowl lid 20 is in the up position, the disc fully contacts the magnet 30 on the end of the actuator linkage 24. The optional decorative tape 60 is included for covering the gap between the toilet tank 12 and the toilet tank cover 36 when the actuator linkage 24 is installed.

Figure 8A:
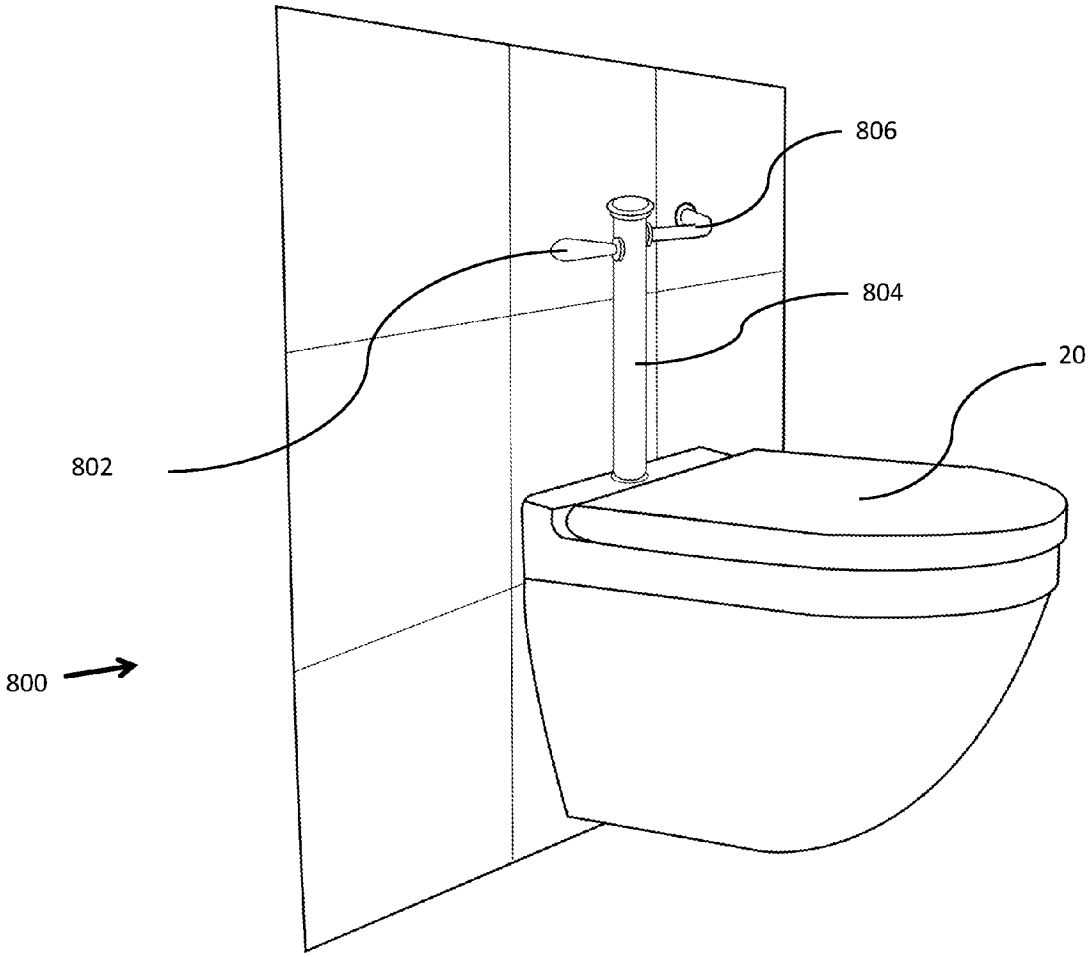
PRIOR ART FIGURE 8A
FIG. 8A is a perspective of an alternate flushometer toilet.
Figure 8B:
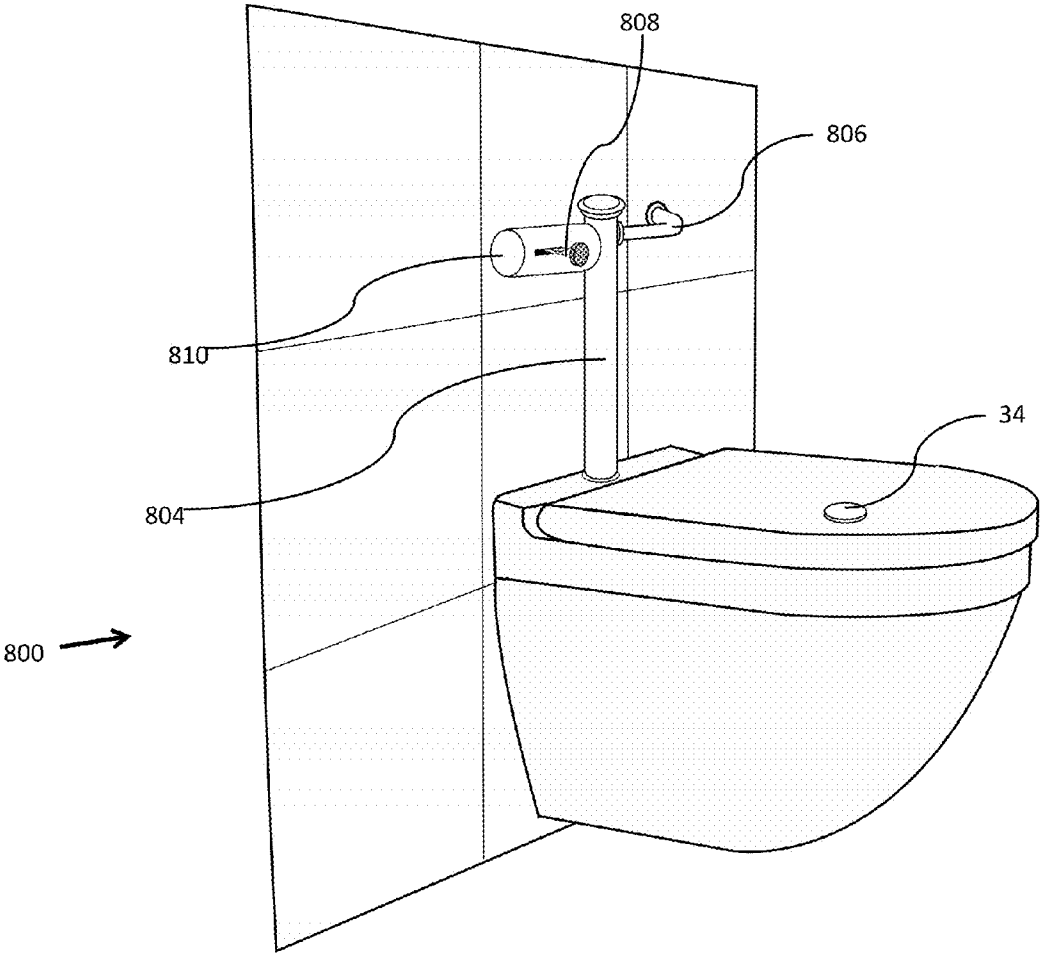
FIG. 8B is a perspective of the flushometer toilet with an alternate embodiment of the present invention.
Figure 8C:
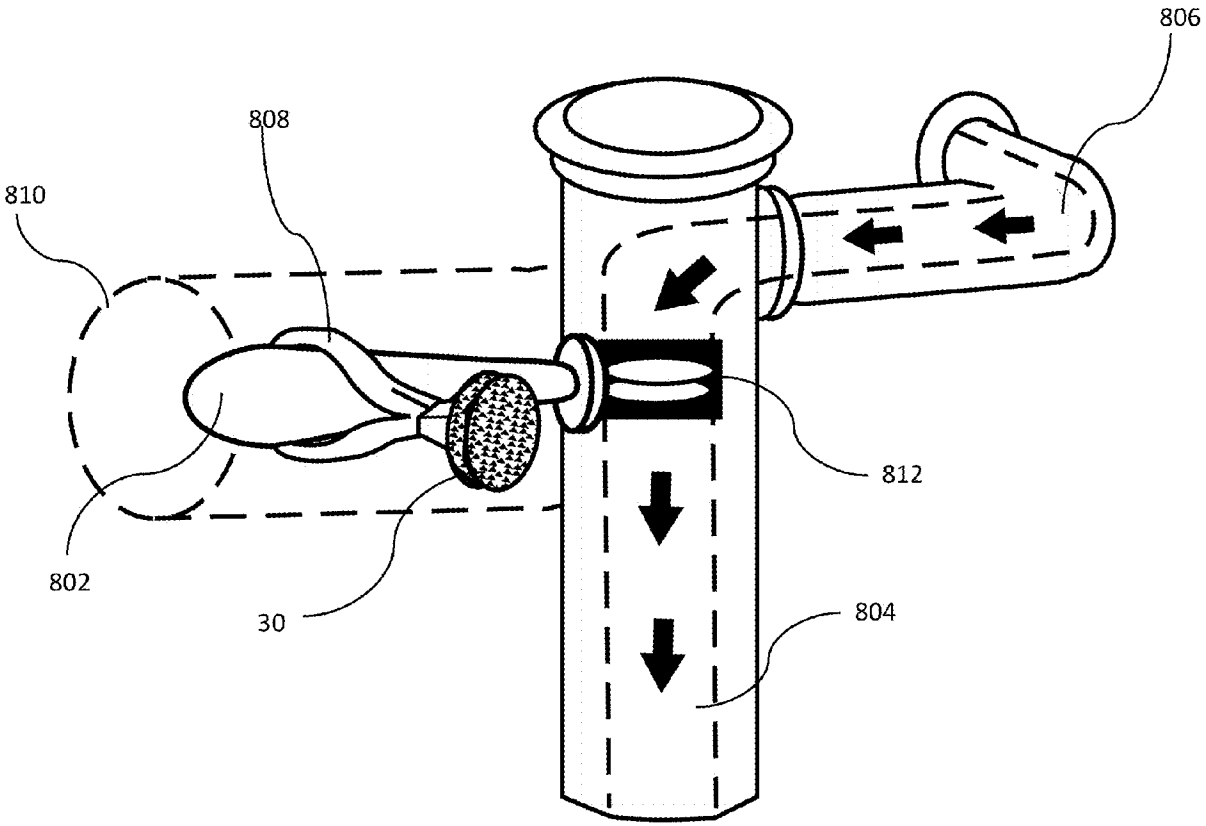
FIG. 8C is a cut away detailed view of the flushometer toilet with an alternate embodiment of the present invention of FIG. 8B.

Referring now generally to the Figures and particularly to FIGS. 8A, 8B and 8C, in typical use of a standard flushometer 800. As shown in FIG. 8A, a prior art handle 802 is attached to a vacuum breaker 804 that is connected to a tailpiece 806 that is further connected through a hole in the wall above the flushometer 800.

The present invention as shown in FIG. 8B wraps an actuator linkage 808 to a handle 802 and is covered by an encapsulating cover 810 with a ferrous disc 34 affixed to a toilet bowl lid 20 in the "down" position.

FIG. 8C shows an actuator linkage 808 attached to a magnet 30 that is wrapped to a handle 802 covered by an encapsulating cover 810. In the view water flows from the tailpiece 806 down through a vacuum breaker 804 and a vacuum breaker kit 812.

Figure 9A:
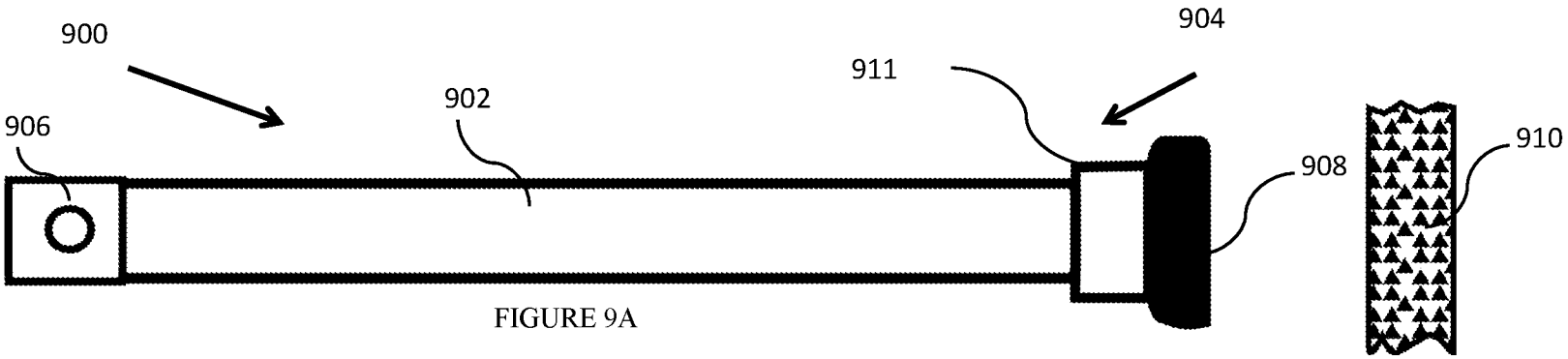
FIG. 9A is a top view of a third alternate embodiment of the invented linkage assembly that includes a thin plastic strip within a third arm.

FIG. 9A is top view of a third alternate embodiment 900 of the invented linkage assembly that includes a thin plastic strip 902 within a third arm 904. An arm aperture 906 is adapted to accept coupling with the drain pull chain 18. An alternate coupling end 908 is a ferromagnetic material that is attracted to a magnetic toilet bowl lid 910 whereby the third arm 904 is detachably attachable to the magnetic toilet bowl lid 910. An attachment feature 911 durably couples the third arm 904 to the alternate coupling end 908.

Figure 9B:
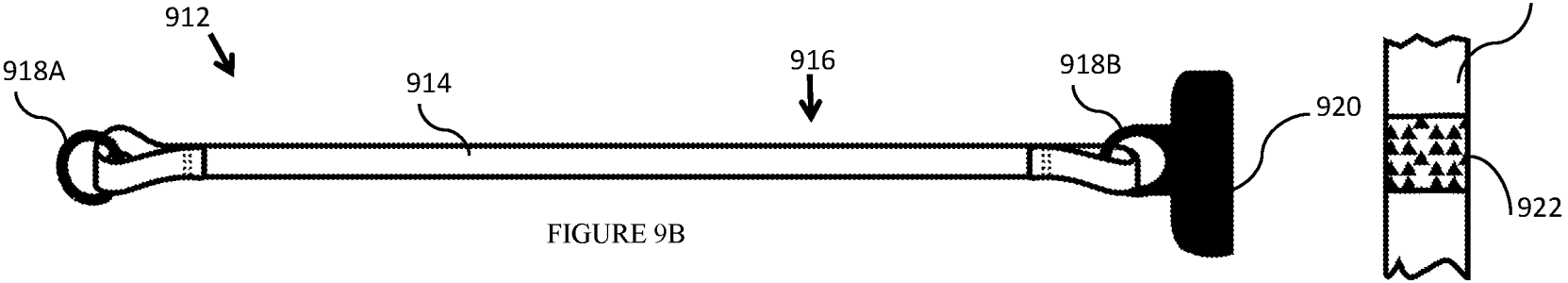
FIG. 9B is a top view of a fourth alternate embodiment of the invented linkage assembly that includes a cord within a fourth arm.

FIG. 9B is top view of a fourth alternate embodiment 912 of the invented linkage assembly that includes a cord 914 within a fourth arm 916. A first cord loop assembly 918A of the cord 914 is adapted to enable coupling of the cord 916 with the drain pull chain 18. The second alternate coupling end 920 is a ferromagnetic material that is attracted to a magnetic portion 922 of a fourth alternate toilet bowl lid 924 whereby the fourth arm 916 is detachably attachable to the fourth alternate toilet bowl lid 924. A second cord loop assembly 918B of the cord 914 is adapted to enable coupling of the cord 916 with the second alternate coupling end 920.

Figure 9C:
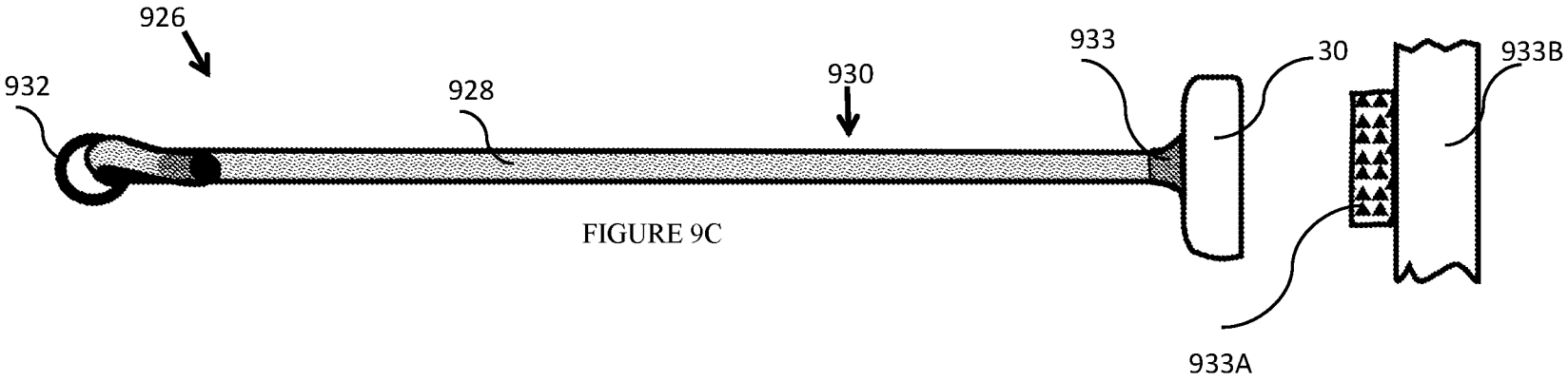
FIG. 9C is a top view of a fifth alternate embodiment of the invented linkage assembly that includes a cable within a fifth arm.

FIG. 9C is top view of a fifth alternate embodiment 926 of the invented linkage assembly that includes a cable 928 within a fifth arm 930. A cable loop assembly 932 of the cable 928 is adapted to enable coupling of the fifth arm 930 with the drain pull chain 18. The second alternate coupling end 920 is attracted to a magnetic disc 933A that is attached to a fifth alternate toilet bowl lid 933B whereby the fifth arm 916 is detachably attachable to the fifth alternate toilet bowl lid 933B.

Figure 9D:
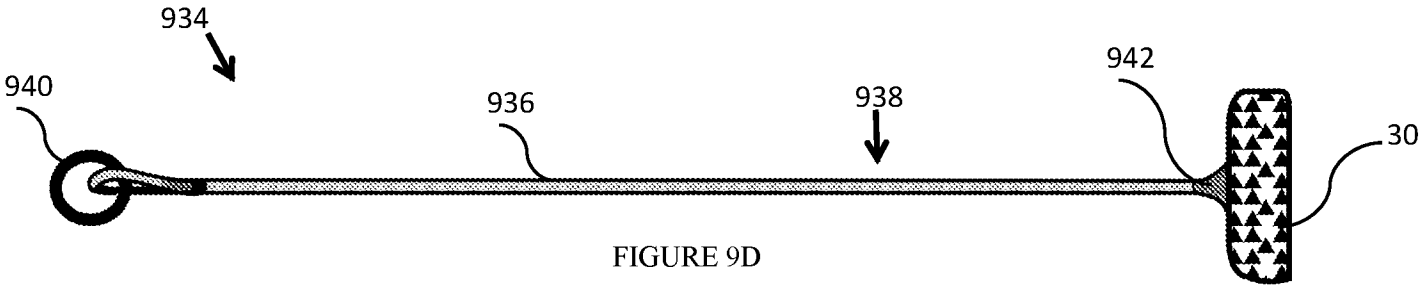
FIG. 9D is a top view of a fourth alternate embodiment of the invented linkage assembly that includes a wire within a sixth arm.

FIG. 9D is top view of a fourth alternate embodiment 934 of the invented linkage assembly that includes a wire 936 within a sixth arm 938. A wire loop assembly 940 of the wire 936 is adapted to enable coupling of the sixth arm 938 with the drain pull chain 18. A second weld 942 couples the sixth arm 938 with the magnet 30.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based herein. Accordingly, the disclosure of the embodiments of the invention is intended to be illustrative, but not limiting, of the scope of the invention, which is set forth in the following claims.

I claim:

1. A kit adapted to convert a toilet, the toilet having a toilet lid rotatably coupled with a toilet seat, a toilet tank and a toilet tank lid and a lever actuated flush mechanism having a toilet pull chain coupled with a flapper valve, to a toilet actuated by lowering of the toilet seat lid toward the toilet seat, the kit comprising:

a first ferromagnetic element adapted to couple to a top surface of the toilet seat lid;

at least one spacer having a height defining a uniform gap between the toilet tank lid and the toilet tank so as to maintain the toilet tank lid above the toilet tank;

an actuator linkage comprising a linear element coupled with a second ferromagnetic element at a first end and having a toilet drain pull chain attachment feature at a second end, the second ferromagnetic element having a magnetic polarity attractive to the first ferromagnetic element; and a linkage guide body integral with a spacer having the height of the at least one spacer configured to maintain the toilet tank lid above the toilet tank, wherein the spacer of the linkage guide body having an open channel between the toilet tank lid and the toilet tank through which the actuator linkage linear element is adapted to extend without contacting the toilet lid in use.

2. The apparatus of claim 1, wherein the first ferromagnetic element comprises a magnet.

3. The apparatus of claim 1, wherein the second ferromagnetic element comprises a magnetically active material.

4. The apparatus of claim 1, wherein the second ferromagnetic element is detachably coupled with the actuator linkage linear member.

5. The apparatus of claim 1, wherein the actuator linkage linear element comprises a strip.

6. The apparatus of claim 1, wherein the actuator linkage linear element comprises a wire.

7. The apparatus of claim 1, wherein the actuator linkage linear element comprises a ribbon.

8. The apparatus of claim 1, wherein the actuator linkage linear member comprises a cable.

9. The apparatus of claim 1, wherein the actuator linkage linear member comprises a cord.

10. The apparatus of claim 1, wherein the actuator linkage linear member comprises a wire.

11. The apparatus of claim 1, wherein the linkage guide body is adapted to position the second ferromagnetic element vertically above a flapper pull chain of the toilet.

12. The apparatus of claim 11, wherein the linkage guide body is further adapted to support the second ferromagnetic element in maintaining the actuator linkage linear member substantively vertical.

13. The apparatus of claim 11, wherein the second ferromagnetic element is detachably coupled with the actuator linkage linear member.

14. The apparatus of claim 13, wherein the first ferromagnetic element comprises a magnet and the second ferromagnetic element comprises a ferromagnetic material.

15. The apparatus of claim 13, wherein the first ferromagnetic element comprises a magnetically active material and the second ferromagnetic element comprises a magnet.

16. The apparatus of claim 11, wherein the actuator linkage linear member flexible member comprises a ribbon.

17. The apparatus of claim 11, wherein the actuator linkage linear member comprises a cable.

18. The apparatus of claim 11, wherein the actuator linkage linear member comprises a cord.

19. The apparatus of claim 11, wherein the actuator linkage linear member comprises a wire.

20. A kit adapted to integrate with a flush valve toilet, the flush valve toilet having a lid, a flush valve and a flush valve actuator, the kit comprising:

a first ferromagnetic element adapted to couple to a top surface of the toilet seat;

an encapsulating cover having an open channel adapted to cover the flush valve actuator;

a flush valve ferromagnetic element coupled with the flush valve, the flush valve ferromagnetic element having a magnetic polarity attractive to the first ferromagnetic element ; and an actuator linkage comprising a linear element extending through the open channel and coupled with the flush valve ferromagnetic element at a first end and having a second end coupled with the flush valve actuator.

* * * * *